United States Patent [19]

Lange

[11] 4,126,099

[45] Nov. 21, 1978

[54] SHIP WITH FLAT BOTTOM TANK AND SHRINK-FIT SYSTEM FOR LATERAL SUPPORT

[75] Inventor: Kenneth W. Lange, Burr Ridge, Ill.

[73] Assignee: Chicago Bridge & Iron Company, Oak Brook, Ill.

[21] Appl. No.: 810,363

[22] Filed: Jun. 27, 1977

[51] Int. Cl.[2] ..... B63B 25/16

[52] U.S. Cl. ..... 114/74 A; 220/18; 220/435; 220/445; 220/468; 220/901

[58] Field of Search ..... 114/74 R, 74 A; 220/9 A, 92 G, 15, 18, 435, 437, 445, 464, 468, 901; 248/DIG. 1, 346

[56] References Cited

U.S. PATENT DOCUMENTS

| | | | |
|---|---|---|---|
| 2,993,460 | 7/1961 | Preyer | 220/15 X |
| 3,076,423 | 2/1963 | Leathard | 220/15 |
| 3,261,586 | 7/1966 | Bengtsson | 114/74 A X |
| 3,882,809 | 5/1975 | Johnson et al. | 114/74 A |
| 3,903,824 | 9/1975 | Laverman et al. | 114/74 A |

*Primary Examiner*—Trygve M. Blix

*Assistant Examiner*—Sherman D. Basinger

*Attorney, Agent, or Firm*—Merriam, Marshall & Bicknell

[57] ABSTRACT

In combination, a ship having a hold, a tank which expands and contracts in the hold for transporting a liquefied gas, the tank comprising a metal shell having a substantially flat metal bottom portion supported by load bearing insulation on the ship hold bottom, the tank having a horizontal collar comprising vertical or sloped wall portions, the hold having a stationary horizontally positioned block having vertical or sloped wall portions having a periphery smaller than the collar, at least the collar wall portions or the block wall portions insulated, whereby at ambient temperature the collar is spaced outwardly from the stationary block periphery and when the tank is at a service lower temperature carrying a liquefied gas the collar contracts with the tank and the collar wall portions tightly contact the block wall portions, and restraining apparatus which prevents horizontal or lateral movement of the tank when empty and at ambient temperature when the ship rolls and pitches.

14 Claims, 7 Drawing Figures

SHIP WITH FLAT BOTTOM TANK AND SHRINK-FIT SYSTEM FOR LATERAL SUPPORT

This invention relates to systems and structures for supporting tanks and similar type objects. More particularly, this invention is concerned with a support system for tanks and the like, and especially those which expand and contract in use, such as tanks used to store and transport cryogenic liquids in ships.

Tanks of metal expand and contract when subjected to a temperature cycle from ambient temperature down to a cryogenic temperature and back to ambient temperature. It is not a difficult problem to provide adequate support systems and structure for relatively small size tanks which go through expansion and contraction cycles since the dimensional change is quite small and can be accommodated rather simply using known engineering solutions and dimensional accommodation during the fabrication and installation thereof. In addition, the stresses created in small size tanks by temperature changes are not significant.

In more recent years, tanks for the storage and transportation of cryogenic liquids or liquefied gases are often of extremely large size. Not only are the overall dimensions of many of the tanks built today quite large, such as over 100 feet or more in major dimension, but the total weight of such tanks has increased substantially, particularly due to the greater weight of the contents, the increased shell thicknesses and auxiliary equipment which must be utilized therewith. The expansion and contraction of such large size metal tanks because of the wide temperature cycles through which they pass in use, makes it necessary that supporting systems and structures for such tanks be able to accommodate the resulting dimensional changes without inducing, or being subjected to, unnecessary stresses in the tank, the tank supports, or in the ship or other structures it may be attached to, which could lead to failure or distortion of the tank or supporting structure.

The prior art shows a number of support systems intended for tanks which are subjected to wide temperature cycles, as see for example the U.S. Pat. Nos. of Miller et al. 3,908,574, Johnson et al. 3,859,805, Sikora et al. 3,792,795 and Bognaes et al. 3,680,323. Miller et al. 3,908,574 discloses a spherical tank for a cryogenic liquid supported in a ship by a series of key-keyway supports. Johnson et al. shows a skirt stabilized tank for a cryogenic liquid which has a flat bottom in contact with a ship hold bottom. Sikora et al. U.S. Pat. No. 3,792,795 shows a spherical tank supported by a series of A-frame supports around the periphery of the tank. Bognaes et al. U.S. Pat. No. 3,680,323 discloses a ship having a spherical tank supported by a cylindrical skirt or shell which joins the tank at its equator. While these tank support systems are useful they are generally costly and involve fabrication difficulties which it is desired to avoid.

There is provided according to the subject invention a novel support system for a tank in cryogenic service which will accommodate the dimensional expansion and contraction that takes place in the tank because of the temperature cycle to which the tank may be subjected. The system is particularly useful for the support of a very large metal tank in a ship. The system utilizes in a broad aspect a horizontal stationary or fixed block or base joined to the ship's hull and having vertical, sloped or inclined peripheral wall or face portions which are surrounded by a temperature contractible collar joined to the tank and having vertical, sloped or inclined wall or face portions spaced around and matching in face arrangement the stationary block wall portions. At least one of the mating collar and block faces is insulated to avoid heat flow which could otherwise take place. This would be undesirable if the block has a peripheral metal ring since it would be cooled simultaneously with the collar and would contract or shrink away from the collar, thereby defeating the desired shrink-fit support. When the tank at ambient temperature is filled with a cryogenic liquid such as a liquefied gas, the tank and collar contract and the collar shrinks tightly around, and creates a viselike grip on, the stationary block. The tank is thereby held firmly and securely in place against lateral movement during service, even when the ship rolls and pitches. Vertical uplift of the tank is also restrained to some extent by friction when the contacting faces are vertical but is positively restrained when the collar portions have inwardly and downwardly sloping faces which match upwardly and outwardly sloping faces on the block portions.

The support system is useful with many shapes of tanks having flat bottoms, including tanks with shells in the form of prisms, such as tanks which are square, rectangular or hexagonal, a truncated sphere, vertical cylinder, elipsoid and tanks having a truncated spherical segment or similar shape joined to a truncated conical segment or any of the above in combination.

The described support system is especially suitable for use in conjunction with a tank which is circular in horizontal section and with a tank having a metal shell with a substantially flat metal bottom portion supported by a suitable load bearing base, such as load bearing insulation on a ship hold bottom. A tank having a flat bottom transfers the vertical load over a much larger area of the ship bottom than does a tank supported by a skirt, columns or key-keyway system located about at the equator of a spherical tank. Further, this arrangement brings the load of the tank and its contents directly to the bottom of the ship's hull and hence to its ultimate support, the upward external pressure of the water beneath the hull.

The described system provides maximum support when the tank is loaded and in service. As the temperature of the tank is raised to ambient temperature the collar expands and moves outward thereby creating an open space between the collar and the surrounding walls of the stationary or fixed block. With the tank empty and at ambient temperature pitching and rolling of the ship may cause the tank to slide for a distance equal to a maximum of twice the radial width of the open space. A restraining means can be employed to hold the tank in position when it is empty and prevent the described sliding. The restraining means can consist of a downward projecting member centrally positioned on the tank bottom and extending into the insulation beneath the tank. One embodiment of restraining means comprises a member cross-shaped in horizontal section which is joined to the bottom of the tank center and fits into and nests in a cross-shaped recess in the load bearing insulation beneath the tank. Another embodiment of restraining means includes a first member, attached to the tank bottom or the ship hold bottom, having a vertical cylindrical external surface, a second member attached to the other of the tank bottom or the ship hold bottom and having a vertical cylindrical internal surface, and insulation between and in contact with the cylindrical surfaces of the first and second members. The first and second members may be made of metal and centrally or axially located with respect to the tank vertical axis so that they are only very slightly and nonaccountably affected by contraction and expansion of the tank bottom. The height of the first and second members is made less than the distance between the tank bottom and the ship hold bottom to avoid a metal path for heat flow from the ship bottom to the tank bottom.

The segments of the collar on the tank can be end-to-end or spaced apart or unitary in the form of a continuous wall. Similarly, the segment wall portions of the stationary or fixed block can be end-to-end or spaced apart or be unitary. The stationary block wall periphery, however, has an external surface smaller than and inside of the collar internal surface.

The invention provides in a rather specific and preferred embodiment the combination of a ship having a hold with a bottom, a tank which is circular in horizontal section which expands and contracts in service in the hold for transporting a liquefied gas, the tank comprising a metal shell having a substantially flat metal bottom portion supported by load bearing insulation on the ship hold bottom, the tank having a horizontal circular collar in the form of a ring with a vertical or sloped internal surface, and the hold having a stationary horizontally positioned block with a vertical or sloped external surface smaller than and inside of the ring internal surface, whereby at ambient temperature the ring internal surface is spaced radially outwardly from the block stationary external surface so that when the tank is at a service lower temperature carrying a liquefied gas the ring internal surface contracts with the tank into hoop tension contact with the block external surface. The block can be located around or be part of the insulation on the ship hold bottom and the ring can be located horizontally out therefrom.

The invention will be described further in conjunction with the attached drawings, in which.

So far as is practical the same elements or parts which appear in the different views of the drawings will be identified by the same numbers.

Figure 1:
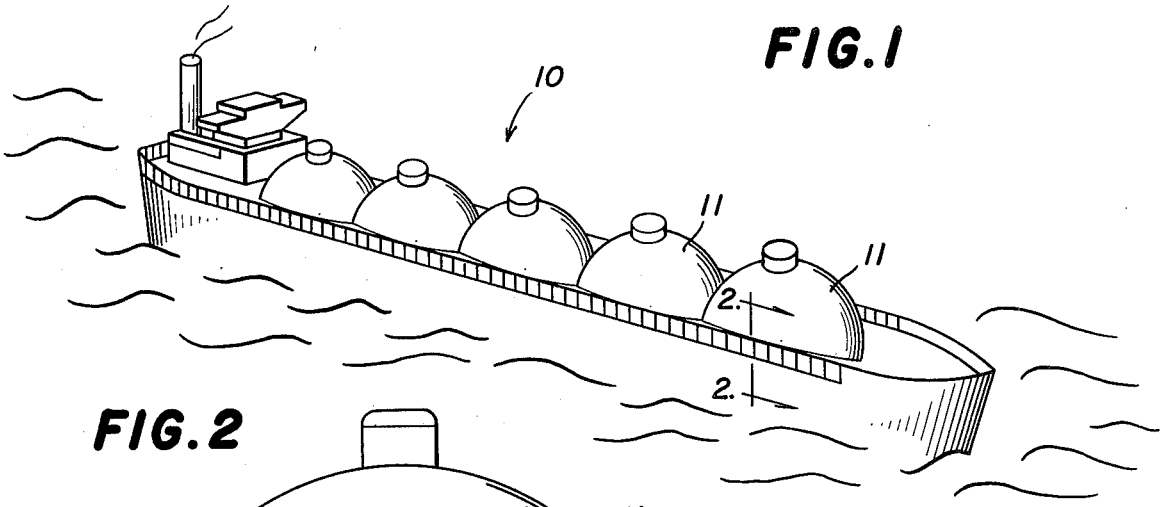
FIG. 1 is an isometric view of a cargo ship having a plurality of spherical segment cargo tanks mounted on the ship hold bottom for transporting a cryogenic liquid such as liquefied natural gas or other liquefied gas.
Figure 2:
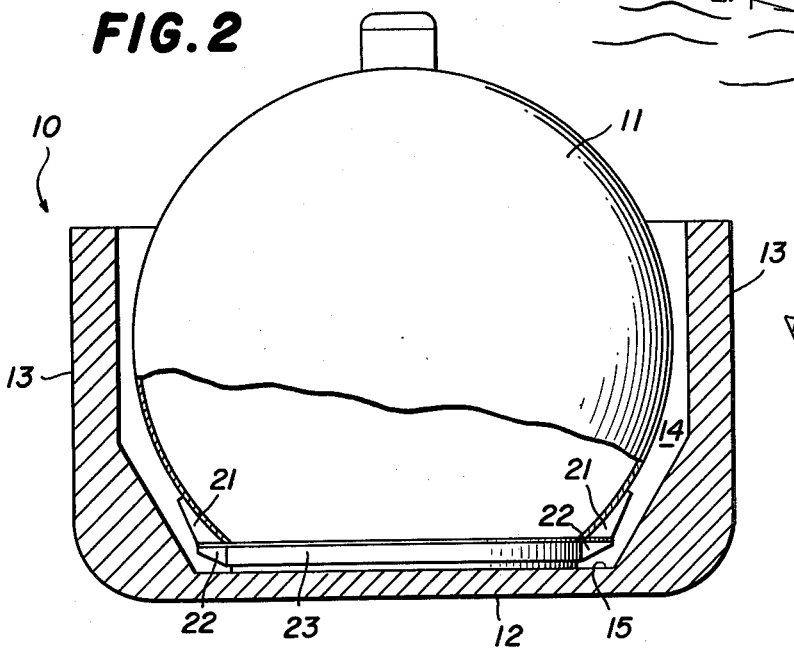
FIG. 2 is a partial sectional view taken along the line 2—2 of FIG. 1.
Figure 4:
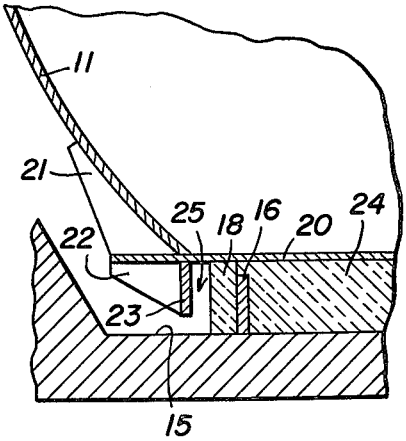
FIG. 4 is a vertical sectional view showing the tank bottom edge and support ring in expanded condition at ambient temperature.
Figure 3:
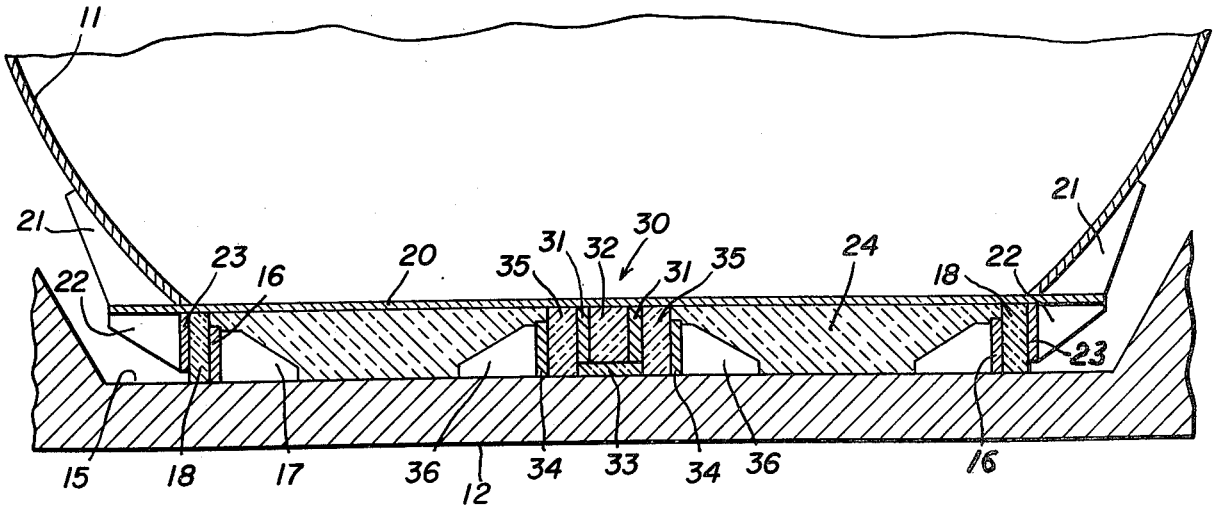
FIG. 3 is an enlarged sectional view of the bottom portion of the tank and support system shown in FIG. 2.

The cargo ship 10 shown in FIG. 1 has five truncated sphere cargo tanks 11 for transporting a liquefied gas. Although not shown in the drawings each of the tanks 11 is insulated to retard heat flow from the ship and the atmosphere into the tank and its low temperature contents. The ship 10 has a hull constituting a bottom 12 and sides 13 which define a ship hold space 14. The ship hold 14 has a flat bottom 15. Extending vertically upwardly from the ship hold bottom 15 is metal circular cylindrical ring 16 (FIGS. 2 to 4) which is reinforced by gussets 17. Strong load bearing insulating block 18 such as Permalie is positioned vertically around the outside surface of cylindrical ring 16. Load bearing insulation 24 is placed between the ship hold bottom 15 and the tank bottom 20 to support and distribute the load. The horizontal flat bottom 20 of tank 11 extends beyond the lower edge of the tank shell and it is reinforced by spaced apart gussets 21 and 22. Cylindrical ring 23 projects downwardly from the lower surface of tank bottom 20 and it is also reinforced by the gussets 22. As shown in FIG. 3 ring 23 is in tight contact with the outer surface of insulation block 18 when a liquefied gas is contained in tank 11. The insulation block 18 and cylindrical ring 16 are held stationary during the temperature cycles through which the tank 11 goes from ambient temperature to a low temperature and then back to ambient temperature. The ring 23 shrinks inwardly when the tank bottom 20 contracts when the tank 11 is lowered from ambient temperature to the temperature at which the liquefied gas is held in the tank. When the liquefied gas is removed and the tank temperature is raised to ambient temperature or thereabouts, the resulting expansion of the tank bottom 20 leads to the production of a clearance space 25 as shown in FIG. 4 between the cylindrical ring 23 and the insulation block 18.

At ambient temperature and with the clearance space 25 developed as indicated, pitching and rolling of the ship could result in lateral sliding of the tank for a distance equal to about twice the radial width of the space 25. A restraining means is accordingly advisably employed in conjunction with the tank support system to eliminate such potential sliding. FIG. 3 illustrates a restraining means 30 which is located about the vertical axis of the tank 11 to minimize any effect which expansion and contraction of the tank might otherwise have thereon. The restraining means 30 as shown in FIG. 3 has a cylindrical metal shell 31 joined to the bottom surface of tank bottom 20. Insulation 32 is placed inside of the cylindrical shell and insulation 33 is placed therebelow extending to the ship hold bottom. A vertical cylindrical metal shell 34 extends upright from the ship hold bottom 15 and is of a larger diameter than the cylindrical shell 31. Insulation 35 is placed between the cylindrical shells 31 and 34. Each of the cylindrical shells 31 and 34 is vertically shorter than the distance between the tank bottom and the ship hold bottom to thereby avoid creation of a direct metal path by which heat could flow from the ship to the tank. Vertical gussets 36 are used to reinforce the vertical shell 34. The described restraining means prevents lateral sliding of the empty tank 11 at ambient temperature even though the space 25 exists.

Figure 5:
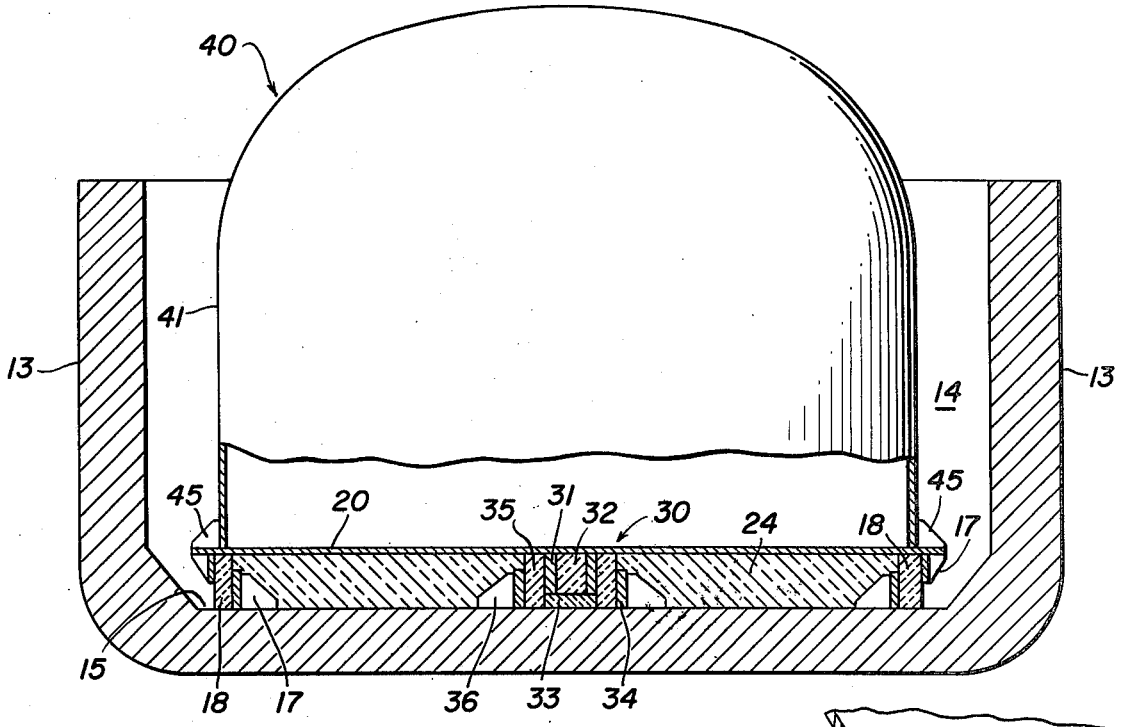
FIG. 5 is a partial vertical sectional view through a ship showing a tank with a cylindrical vertical shell supported by the ship hold bottom.
Figure 6:
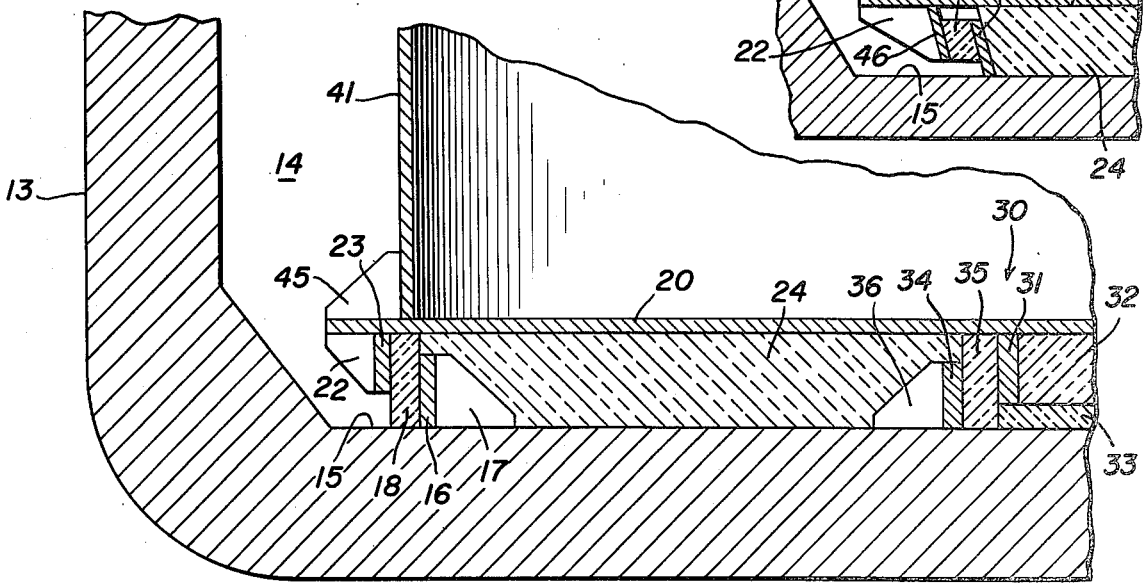
FIG. 6 is an enlarged vertical sectional view of a bottom portion of the tank and support system shown in FIG. 5.

A second embodiment of the invention is shown in FIGS. 5 and 6. In this embodiment the tank 40 has a vertical cylindrical shell 41 which is joined to tank bottom 20. The support system for the cylindrical wall tank 40 of FIGS. 5 and 6 is in all significant respects like that shown in FIGS. 1 to 4 and this also applies to the centrally located restraining means 30. However, a gusset 45 is used to reinforce the projecting peripheral edge of bottom 20 as shown in FIG. 6 rather than a gusset 21 as shown in FIG. 3.

Figure 7:
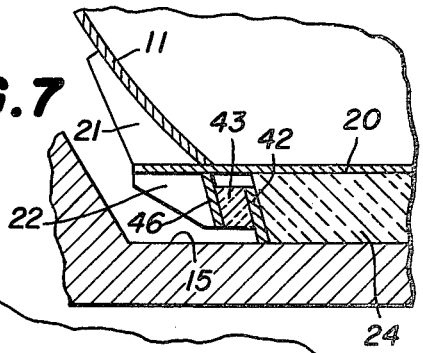
FIG. 7 is a vertical sectional view of the bottom edge of a tank having a sloped support collar and matching sloped face on a stationary or fixed ring.

FIG. 7 illustrates a further embodiment of the invention. In this embodiment horizontal collar 46, joined to the bottom of tank bottom 20 slopes or inclines inwardly as it extends downwardly. Horizontal ring 42 is joined to the bottom of the ship hold and slopes or is inclined outwardly as it extends upwardly. Insulation block 43 having parallel sides is joined to the outer face of ring 42 and its outer side is thereby at an angle of inclination which matches that of the collar 46. This support system embodiment not only prevents lateral movement of the tank but also prevents upward movement of the tank relative to the ship hold bottom. This is desirable since some codes require that such ship tanks be restrained against uplift, such as may be caused if the ship hold floods.

The foregoing detailed description has been given for clearness of understanding only, and no unnecessary limitations should be understood therefrom as modifications will be obvious to those skilled in the art.

What is claimed is:

1. In combination:

a ship having a hold with a bottom;

a tank which expands and contracts in service in the hold for transporting a liquefied gas;

the tank comprising a metal shell having a substantially flat metal bottom portion supported by load bearing insulation on the ship hold bottom;

the tank having a horizontal collar comprising wall portions;

the hold having a stationary horizontally positioned block describing a periphery smaller than the collar;

at least one of the collar and the block being insulated;

said collar being spaced outwardly from the stationary block periphery at ambient temperature and when the tank is at a service lower temperature carrying a liquefied gas said collar contracting with the tank into tight contact with the block; and restraining means which prevents horizontal or lateral movement of the tank when empty and at ambient temperature when the ship rolls and pitches.

2. A combination according to claim 1 in which the tank is a truncated sphere.

3. A combination according to claim 1 in which the tank has a vertical cylindrical wall.

4. A combination according to claim 1 in which the restraining means includes a downward projecting member centrally positioned on the tank bottom and extending into the insulation.

5. A combination according to claim 1 in which the block is located around the insulation on the ship hold bottom.

6. A combination according to claim 1 in which the restraining means includes a first member, attached to the tank bottom or the ship hold bottom, having a vertical cylindrical external surface, a second member attached to the other of the tank bottom or the ship hold bottom and having a vertical cylindrical internal surface, and insulation between and in contact with the cylindrical surfaces of the first and second members.

7. In combination:

a ship having a hold with a bottom;

a tank, which is circular in horizontal section which expands and contracts in service in the hold for transporting a liquefied gas;

the tank comprising a metal shell having a substantially flat metal bottom portion supported by load bearing insulation on the ship hold bottom;

the tank having a horizontal circular ring with an internal surface;

the hold having a stationary horizontally positioned external surface smaller than and inside of the ring internal surface;

at least one of the ring internal surface and the hold external surface being insulated;

whereby at ambient temperature the ring internal surface is spaced radially outwardly from the hold stationary external surface and when the tank is at a service lower temperature carrying a liquefied gas the ring internal surface contracts with the tank into hoop tension contact with the hold external surface; and restraining means which prevents horizontal or lateral movement of the tank when empty and at ambient temperature when the ship rolls and pitches.

8. A combination according to claim 7 in which the restraining means includes a downward projecting member centrally positioned on the tank bottom and extending into the insulation.

9. A combination according to claim 7 in which the ring internal surface is located around the insulation beneath the tank bottom.

10. A combination according to claim 7 in which the restraining means includes a first member, attached to the tank bottom or the ship hold bottom, having a vertical cylindrical external surface, a second member attached to the other of the tank bottom or the ship hold bottom and having a vertical cylindrical internal surface, and insulation between and in contact with the cylindrical surfaces of the first and second members.

11. In combination:

a ship having a hold with a bottom;

a tank which expands and contracts in service in the hold for transporting a liquefied gas;

the tank comprising a metal shell having a substantially flat metal bottom portion supported by load bearing insulation on the ship hold bottom;

the tank having a downwardly projecting horizontal collar;

the hold having a stationary upwardly projecting horizontally positioned block having a periphery smaller than the collar;

at least one of the collar and the block being insulated;

whereby at ambient temperature the collar is spaced outwardly from the stationary block periphery and when the tank is at a service lower temperature carrying a liquefied gas the collar contracts with the tank and the collar tightly contacts the block; and restraining means which prevents horizontal or lateral movement of the tank when empty and at ambient temperature when the ship rolls and pitches.

12. In combination:

a ship having a hold with a bottom;

a tank, which is circular in horizontal section which expands and contracts in service in the hold for transporting a liquefied gas;

the tank comprising a metal shell having a substantially flat metal bottom portion supported by load bearing insulation on the ship hold bottom;

the tank having near its bottom a horizontal circular ring with an internal surface;

the hold having near its bottom a stationary horizontally positioned external surface smaller than and inside of the ring internal surface;

at least one of the ring internal surface and the hold external surface being insulated;

whereby at ambient temperature the ring internal surface is spaced radially outwardly from the hold stationary external surface and when the tank is at a service lower temperature carrying a liquefied gas the ring internal surface contracts with the tank into hoop tension contact with the hold external surface; and restraining means which prevents horizontal or lateral movement of the tank when empty and at ambient temperature when the ship rolls and pitches.

13. In combination:

a ship having a hold with a bottom;

a tank, which is circular in horizontal section which expands and contracts in service in the hold for transporting a liquefied gas;

the tank comprising a metal shell having a substantially flat metal bottom portion supported by load bearing insulation on the ship hold bottom;

the tank having at its bottom a downwardly projecting horizontal circular ring with an internal surface;

the hold having at its bottom a stationary upwardly projecting horizontally positioned external surface smaller than and inside of the ring internal surface;

at least one of the ring internal surface and the hold external surface being insulated;

whereby at ambient temperature the ring internal surface is spaced radially outwardly from the hold stationary external surface and when the tank is at a service lower temperature carrying a liquefied gas the ring internal surface contracts with the tank into hoop tension contact with the hold external surface; and restraining means which prevents horizontal or lateral movement of the tank when empty and at ambient temperature when the ship rolls and pitches, said restraining means including a downward projecting member centrally positioned on the tank bottom and extending into the insulation.

14. A combination according to claim 13 in which the restraining means includes a first member, attached to the tank bottom or the ship hold bottom, having a vertical cylindrical external surface, a second member attached to the other of the tank bottom or the ship hold bottom and having a vertical cylindrical internal surface, and insulation between and in contact with the cylindrical surfaces of the first and second members.

* * * * *